US006352034B1

(12) United States Patent
Bolliger et al.

(10) Patent No.: US 6,352,034 B1
(45) Date of Patent: Mar. 5, 2002

(54) INSTALLATION FOR AMUSEMENT PARK, INSTALLATION REFERRED TO AS ROLLER COASTER

(75) Inventors: Walter Bolliger, Antagnes; Claude Mabillard, Choëx, both of (CH)

(73) Assignee: Bolliger & Mabillard Ingenieurs Conseils S.A., Monthey (CH)

( * ) Notice: Subject to any disclaimer, the term of this patent is extended or adjusted under 35 U.S.C. 154(b) by 0 days.

(21) Appl. No.: 09/426,801

(22) Filed: Oct. 22, 1999

(30) Foreign Application Priority Data

Jan. 11, 1999 (CH) ..... 0044/99

(51) Int. Cl.[7] ..... A63G 7/00

(52) U.S. Cl. ..... 104/53; 104/27; 104/28; 104/30; 104/31

(58) Field of Search ..... 104/53, 63, 124, 104/125, 288, 55, 56, 246, 27, 28, 30, 31, 76; 187/211, 240, 269; 105/425, 430, 436

(56) References Cited

U.S. PATENT DOCUMENTS 3,889,605 A * 6/1975 Bacon ..... 104/56
4,308,697 A * 1/1982 Guppy ..... 104/31
4,694,522 A * 9/1987 Alten ..... 104/121
5,148,751 A * 9/1992 Alten et al. ..... 104/31
5,272,984 A * 12/1993 Bolliger et al. ..... 104/63
5,357,869 A * 10/1994 Barjolle et al. ..... 105/436
5,463,962 A * 11/1995 Gnezdilov ..... 104/55
5,595,121 A * 1/1997 Elliott et al. ..... 104/53
5,613,575 A * 3/1997 Ackermann ..... 187/211
6,098,549 A * 8/2000 Mares ..... 104/76

* cited by examiner

*Primary Examiner*—S. Joseph Morano
*Assistant Examiner*—Lars A. Olson
(74) *Attorney, Agent, or Firm*—Clifford W. Browning; Woodard, Emhardt, Naughton, Moriarty & McNett

(57) ABSTRACT

The installation for amusement park, referred to as roller coaster, comprises a circuit made up of rails (6), mounted on supports (10), themselves fixed on a carrier beam (11), on which one or more vehicles run, designed to run on the rails, as opposed to a suspended roller coaster, and at least one station for the embarkation and disembarkation of passengers. Each vehicle comprises a main beam (1), at least one transverse chassis element (2) on which are mounted, on the one hand, wheels (3, 4, 5) interacting with the rails (6), and, on the other hand, seats (7) provided with retention means (8). The station, which comprises at least one platform (12) likewise comprises a fold-away floor (14), which replaces the floor, absent of the vehicle, when the vehicle is stopped in a predetermined position for embarkation and disembarkation. Due to this, the vehicle may be designed without any floor. As a result, no bodywork element except the main beam, will be interposed between the eyes of the passenger and the rails (6) or the support (10) of the rails respectively.

7 Claims, 3 Drawing Sheets

INSTALLATION FOR AMUSEMENT PARK, INSTALLATION REFERRED TO AS ROLLER COASTER

The present invention relates to an installation for amusement park, installation referred to as roller coaster.

Whatever their generation or their categories and sub-categories, all roller coasters have certain immutable characteristics in common, which make these installations a creation apart, and a unique type.

In the first instance, they involve circuits in which after having been towed to the starting point of the circuit, vehicles then move at significant speeds, sometimes 100 kilometres an hour or more at the peak, under the combined effect of the trace of the track, which consists of one or more rails, and of gravity. The vehicles move on, beneath, or at the side of the rail(s), depending on the category or sub-category concerned.

In the second instance, the circuits of roller coasters are not long rectilinear toboggans; on the contrary, they have track traces which consist of concatenations of various acrobatic shapes, diverse and more or less daring. These track traces impose acceleration values on the passengers which are also as widely diverse and varied as the figures adopted, and which may, momentarily, amount to several g.

In the third instance, the aim of the roller coasters is not to transport or convey the passengers for the purpose of the voyage. The ingredient, albeit definitely subjective, which constitutes the true aim of the roller coasters is to provide the passengers with something different, to offer them an experience and sensations which are out of the ordinary.

From the point of view of these sensations, each passenger probably experiences a different sensation, and, on the assumption that the same passenger goes all over the circuit several times, it is also probable that he will not undergo the same experience twice over.

The enormous success of the roller coaster among the public is due to the fact that the cocktail of sensations is as inevitable as it is changeable, but it changes nothing in the fact that this cocktail is always deliciously explosive.

Among the sensations or emotions which may be mentioned there are, clearly, the exhilaration of the speed, the vertigo, the acceleration, the loss of orientation, the feeling of flying and of hurtling through space, but there is also the sense of risk and of its infinite subordinate emotions, the whole range of fears, mental or irrational, and the parallel range of various degrees of satisfaction of having conquered one's fear for some or of having overcome one's apprehension for others.

It is true that these elements are less technical, but they are fundamental, because every technique employed is not an end in itself; the ultimate aim of the technique is, and remains, to create these emotions, to emphasise them, and to cause new expressions of these emotions to be borne of the imagination; in brief, to render the cocktail more attractive and still more explosive.

In this spirit, the objective of the present invention is to propose a roller coaster offering all the customary shaped and figures in the usual comfort and safety, but in which each passenger has, from the point of view of their emotions, on the one hand the feeling of being seated astride on the buffer beam of a railway wagon, set in motion at great speed, and, on the other hand, also has the disquieting view of the close and dizzying twist and turn of the rails and the sleepers beneath him, indeed just beneath him.

Up to now, the element of the feeling of risk has always been present with roller coasters, but, by contrast, it has never been cultivated for its own sake and applied as is the case with the present invention, or at least never to this degree.

There are two main known types of roller coaster, those which run on rails and those which run beneath them, known as suspended roller coasters.

In order to achieve the objective of the invention as described heretofore, the installation necessarily belongs to the category of roller coasters which run on rails. If, as is intended, inspired by a vision from a nightmare, the passenger is obliged to see rails and sleepers falling away beneath him, nothing should be interposed between the passenger and the rails; in other words, there should be no floor.

A sub-category of the suspended roller coasters already offers the particular feature of having neither walls nor floors around the passenger. One example is provided in European Patent EP 0545860. There is, however, one important difference between a suspended roller coaster such as this and a roller coaster running on rails. In either case, the passengers board and alight at a station. In the case of the suspended roller coaster without a floor, when the train arrives in the station the distance between the feet of the passengers and the ground decreases progressively, in the manner of the arrival of a chair lift. The train stops, and, as the case may be, jack elements raise the base from the ground by some centimetres, and the passengers disembark in order to yield their places to those embarking. There is no need for a floor, since the ground (or whatever takes its place) fulfils this role.

With a roller coaster which runs on rails, the elimination of the floor of the vehicle is a different matter entirely. In effect, when it comes to boarding and alighting, the floor is essential. It is for this reason that, among roller coasters which run on rails, none are known which do not have a floor.

In order to create the roller coaster according to the invention, it is necessary to break the taboo, i.e. to remove an indispensable element, the floor of the vehicle, while striving as a consequence to fulfil its function by another means which remains to be created, if possible.

The installation, referred to as a roller coaster, according to the invention, comprises:

- a circuit formed of rails, mounted on supports which are themselves fixed on a carrying beam, on which there run:
- one or more vehicles, designed to run on the rails, as opposed to suspended roller coasters,
- and at least one station for passengers to embark and disembark, each vehicle comprising a main beam, at least one transverse chassis on which are mounted, on the one hand, wheels which interact with rails, and, on the other hand, seats provided with retention means, and the station comprising at least one platform, wherein the station, or its platform respectively, comprise a fold-away floor which replaces the absent floor of the vehicle when the vehicle is stopped in a predetermined position for embarkation/disembarkation, and accordingly allows for the vehicle to be constructed without any floor, and, in consequence, avoid any bodywork element to be interposed between the eyes of the passenger and the rails or the rail supports respectively.

The vehicles of the installation comprises a main beam, at least one transverse chassis on which are mounted, on the one hand, wheels interacting with rails and, on the other, seats provided with retention means, and nothing else, in particular no floor.

In the station of the installation, the fold-away floor and its means for control, deployment, and retraction, are of one and the same piece with the station or of its platform respectively.

A preferred embodiment of the installation according to the invention is described by reference to the drawings, in which.

Figure 1:
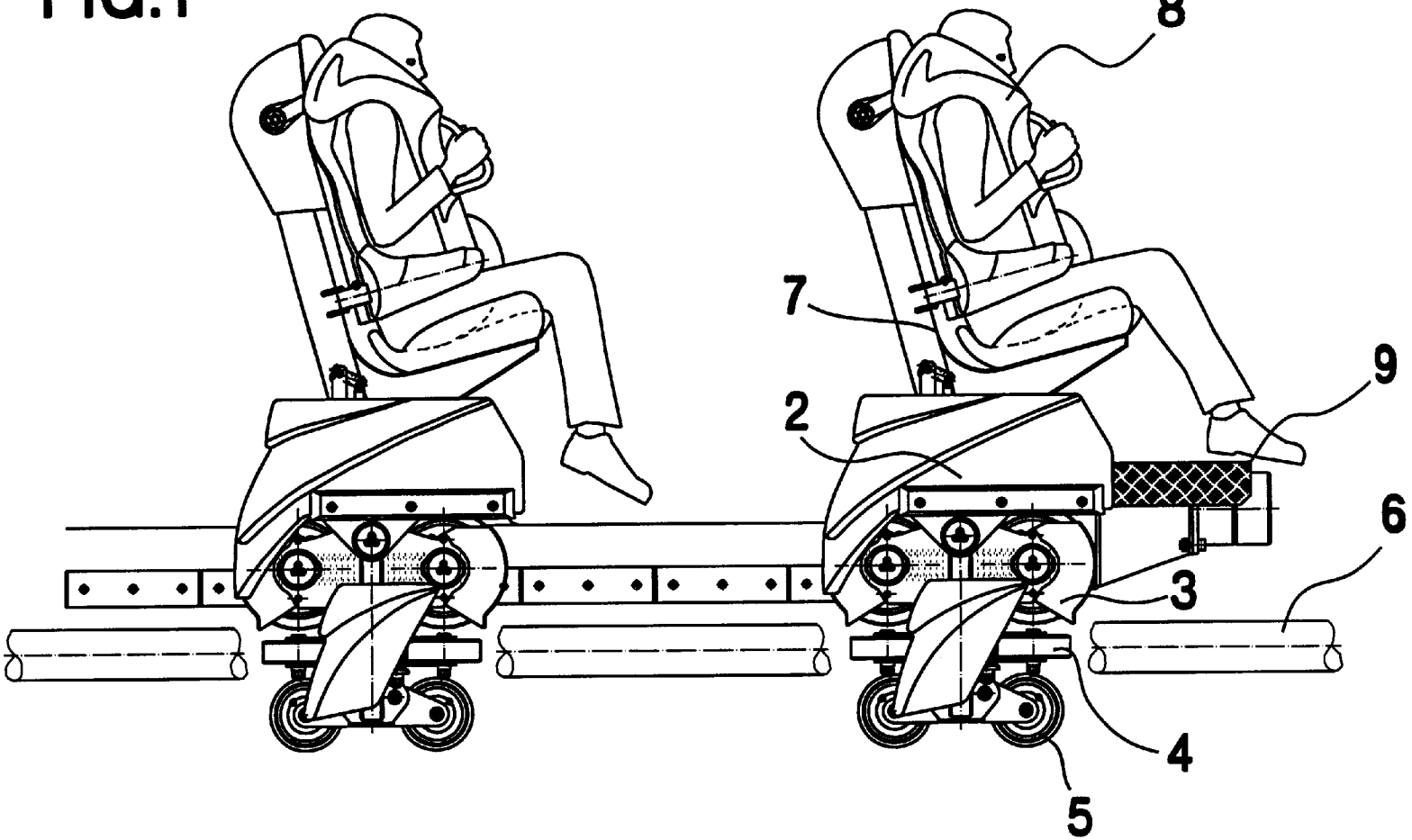
FIG. 1 shows a profile view of the vehicle of the installation according to the invention.
Figure 2:
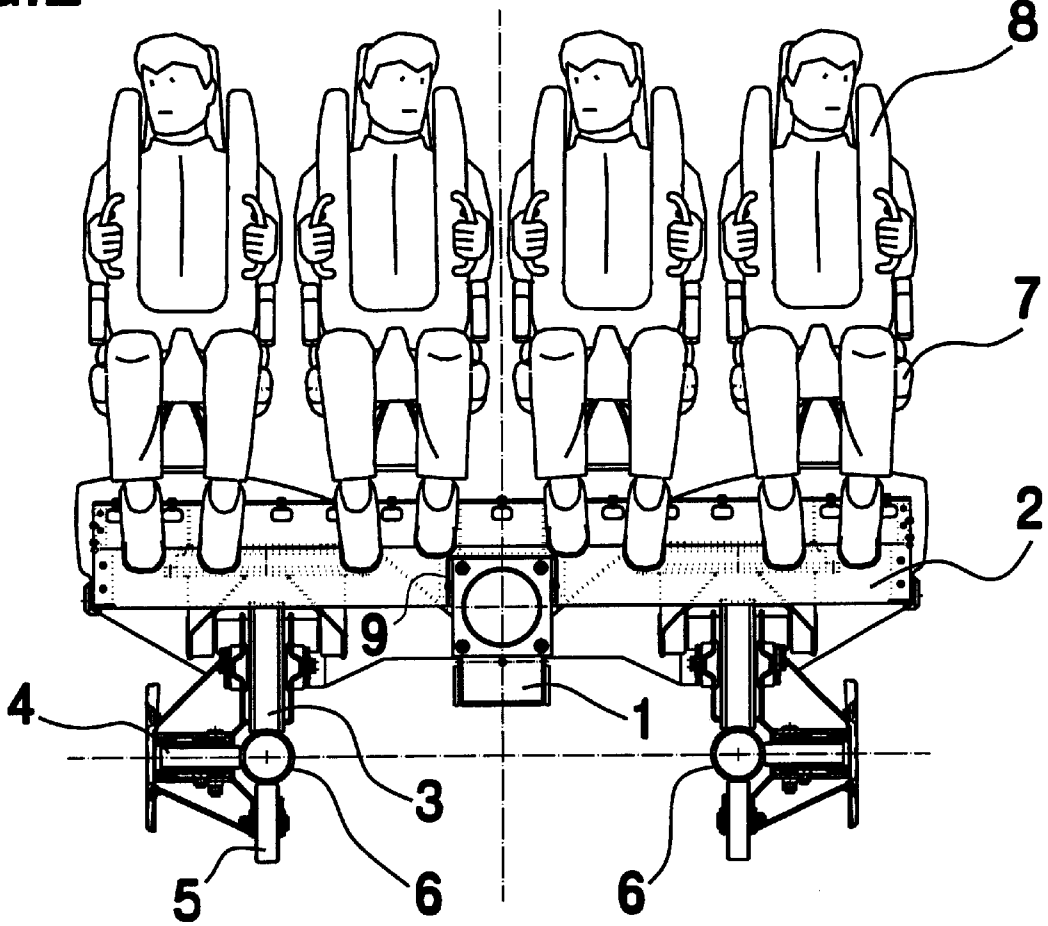
FIG. 2 shows a frontal view of the profile of the vehicle of the installation according to the invention.

When considering FIGS. 1 and 2, it can be seen that the vehicle is essentially reduced to its simplest possible expression. It consists essentially only of a central beam 1, transverse chassis elements 2, on which are mounted, three by three, six pairs of wheels 3, 4 and 5, which run in the conventional manner on rails 6 on three sides. The seats 7 are mounted on the transverse chassis elements and bear the conventional retaining means 8. That is all.

In FIG. 1 it can be seen that the part of the central beam which extends slightly in front of the vehicle is provided with a protective packing element 9, which does not by any means constitute a footplate for the passengers, as FIG. 2 demonstrates.

In FIG. 1 there are only two rows of passengers shown, and the remainder of the train, which can be of greater or lesser length, is nothing more than a repetition of what is shown in the drawing. What is very clearly evident in the drawing is that there is no floor; there is strictly nothing between the transverse chassis elements, nor is there anything around the passengers. The train is bare; the gap between the transverse chassis elements is exempt of any obstruction to the passenger's view downwards, with the sole exception of the central beam, which is not, however, in the vertical position in respect of any of the passengers. This gap is also available for use, i.e. capable of accommodating an outside element.

Figure 3:
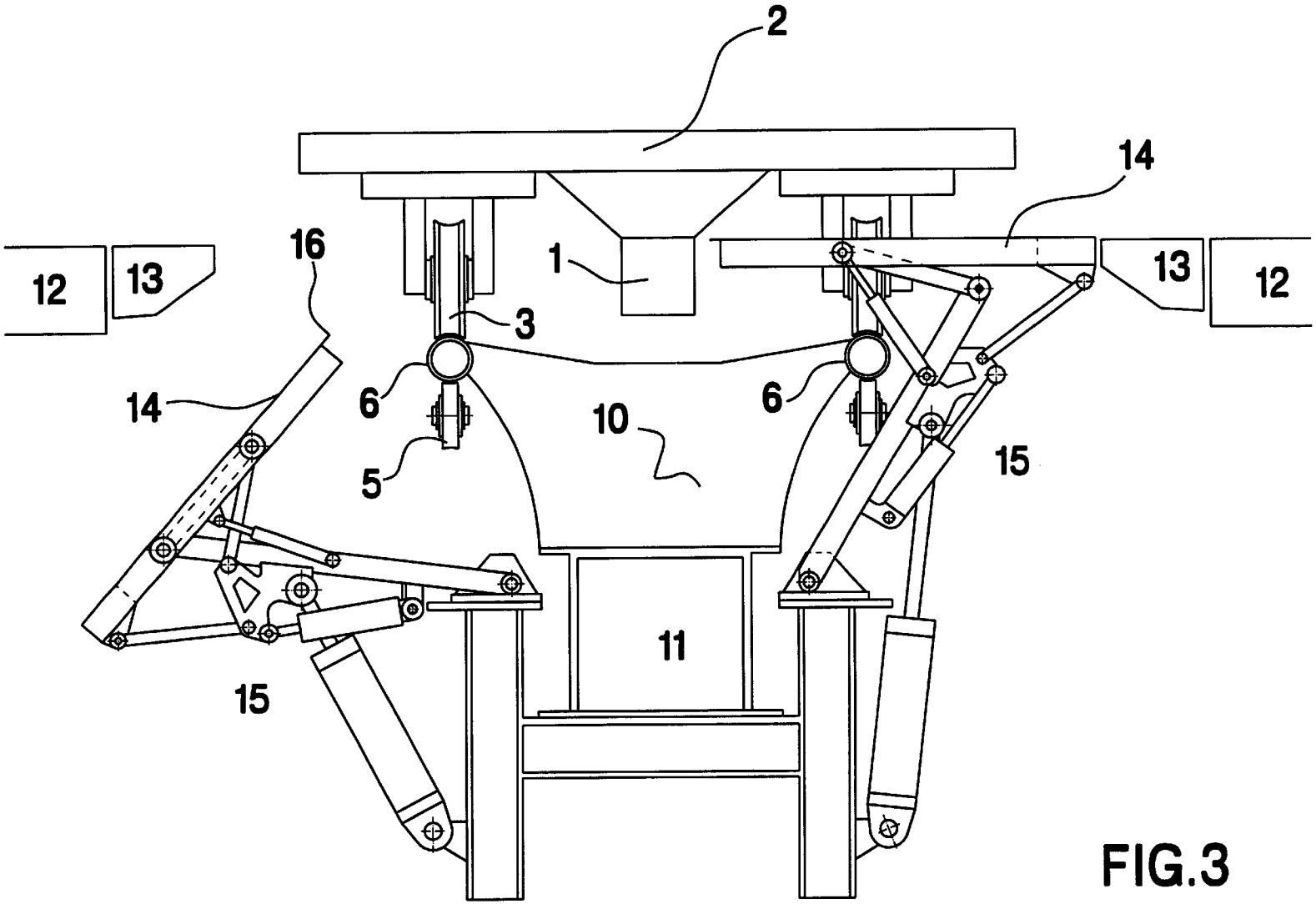
FIG. 3 shows a frontal view of the vehicle when it is in the station, and also shows a profile view of the special equipment with which the station is provided in the installation according to the invention.

FIG. 3 allows for a sight of what outside element may be involved. The figure shows in simplified fashion the same constituent parts of the vehicle as FIG. 2, namely the central beam 1, the transverse chassis 2, two pairs of wheels 3 and 5, the third pair not being shown in order to avoid overloading the drawing. The rails 6 can also be seen fixed on the rail supports 10.

Before going any further with the description of the features of interest in FIG. 3, it is appropriate to recall certain elements which do not appear or are not derived from the drawing, but of which note should be taken.

In the first instance, even at the location of the station for embarking and disembarking, the installation is in general suspended in the air, i.e. at a certain distance from the ground. The rails 6 are supported by support elements 10, themselves carried on a beam 11. This beam may be made of metal, of any form whatever, or of concrete, likewise of any form whatever. This beam rests on columns which are not shown in the drawing.

In the second instance, at the location of the station, there is at least one platform, but more generally two 12, terminated, as applicable, by a metallic profile element 13.

Bearing this in mind, FIG. 3 also shows the element which forms the complement for the vehicle, namely a fold-away floor. This fold-away floor does not form part of the vehicle but is of one piece with the fixed part of the installation, and it is in this that the great originality of the invention rests.

The floor proper 14 is made of sheet metal and is fixed on a pivot on a set of hydraulic jacks 15, supported at the pivot point by the carrier beam 11. The set of jacks is organised in this case in such a way as to combine two movements which will allow the floor to move over the rail, mainly by means of a rotational movement, then, once the rail has been cleared, to revert to its horizontal position, mainly by means of a linear extension movement.

The left-hand part of the drawing shows the floor in its folded-away position, and the right-hand part shows the floor in its blocking position, in the embarking-disembarking configuration. The functioning of the two parts (to the right and the left of the vehicle) of the fold-away floor is of course symmetrical, with the sets of jacks operating together.

The metal sheet which constitutes the surface proper of the floor is shaped in such a way as to best match the contour of the transverse chassis elements, also taking account of the shape of the wheels and the brackets which hold them; in brief, it is designed in such a way as to reconstitute the floor of the vehicle, while leaving the fewest possible interstices.

Depending on the length of the train and therefore the number of rows of passengers, it is possible to deploy several sets of jacks and to create the fold-away floor in several sections. There is a great deal of freedom in the choice of division into sections and the positioning of the sets of jacks. None of the numerous options possible is predominant so that to describe one in particular would bring nothing more.

Since the vehicle must interact with the fold-away floor which is fixed to the immovable part of the installation, it is necessary to make provision for the adequate monitoring of the position of the vehicle, for example by way of electromagnetic detectors, in such a way as to prevent the deployment of the floor as long as the vehicle is in the desired position.

In the same sense, it is a good idea to make provision for a command system to stop and fold back the floor in the event of any obstacle being encountered. A sensitive tongue element 16, comparable to those found on elevator doors, for example, is in any event indicated.

FIG. 3 shows the preferred embodiment, without doubt the most sophisticated. Recourse can, however, be made to two other variants at least. In the first instance, the fold-away floor can be formed of a succession of drawer elements accommodated in the platform, which deploy under the effect of jacks when the vehicle is in position. In the second instance, recourse can also be made, in the same sense, to a succession of telescopic pontoons, likewise accommodated within the platform, which deploy in the same manner. However, the variant represented in the drawing in FIG. 3 remains the preferred embodiment, because it allows for greater liberty in the design of the contour of the sheet which constitutes the floor, and thus allows for the interstices between the floor and the vehicle to be reduced to the minimum.

The advantages of the roller coaster according to the invention are, first, to achieve the aim described above, i.e. to offer the passengers an entire range of emotions so strong as to be virtually raw. Clearly it is not possible to please all the people all of the time, and those who already need to pluck up courage to ride a conventional roller coaster may perhaps be afraid, but those who are truly seeking the emotions and pleasures so specific to the roller coaster will find themselves presented with a thrill of an intensity never offered by any other installation, and will not be disappointed.

From the point of view of the operator of the park, there are advantages from both the technical and commercial points of view. Maintenance of the installation vehicle according to the invention is facilitated by the stripped-down nature of the vehicle, all of which is immediately accessible. Maintenance of the hydraulic parts of the station is also something which can be carried out perfectly, if only by the experience gained from building site equipment. If the concept of the installation is innovative, the elements which go into its realisation are all known and recognised for their reliability, and for the complete control with which they can be used. On the commercial level, there is plainly the attraction of an installation which offers something never before encountered, and the large number of visitors which such an installation will attract. It also needs to be borne in mind, however, that in terms of turnover, and of costs of manufacture and of maintenance, the lightness of the vehicles and their compact design will allow for cheap manufacture, and therefore substantial profits.

What is claimed is:

1. A roller coaster comprising:

a circuit formed of rails, mounted on supports, which are themselves fixed on a carrying beam, on which run:

one or more vehicles, designed to run on the rails, and at least one station for passengers to embark and disembark; each vehicle comprising a main beam and at least one transverse chassis on which are mounted wheels, which interact with the rails, and seats provided with retention means, but each vehicle having no floor; and the station comprising at least one platform, wherein the station, or its platform, further comprises a fold-away floor, which serves as a floor in each vehicle when each vehicle is stopped in a predetermined position for embarkation/disembarkation, and accordingly allows each vehicle to be constructed without any floor.

2. Installation according to claim 1, further comprising, on the vehicle and/or in the station, means for adjusting the position of the vehicle, intended to determine a defined position for the vehicle to stop, in such a way that the fold-away floor is deployed into the gap between two transverse chassis elements of the vehicle.

3. A roller coaster according to claim 1, wherein, at the location of the station, a fold-away floor is mounted on a pivot on a set of jacks, themselves fixed to a carrier beam, the set of jacks being arranged in such a way that the floor moves over the rail when passing from its folded-away position into its working position, essentially horizontally.

4. Installation according to claim 3, wherein the shape of the fold-away floor is chosen to form a semi-match for the contours of the transverse chassis elements of the vehicle, such as to leave between the floor and the vehicle the minimum possible operational interstices.

5. Installation according to claim 1, wherein the fold-away floor comprises at least one sensor intended to control the stopping and deployment of the floor when it encounters an obstacle.

6. A vehicle for a roller coaster for installation with a fold-away floor, not accompanying the vehicle, according to claim 1, comprising a main beam, at least one transverse chassis on which are mounted, or the one hand, wheels interacting with rails, and, on the other, seats provided with retention means, and no floor.

7. Station for installation with fold-away floor, not accompanying the vehicle, according to claim 1, wherein the fold-away floor and its means for control, deployment, and retraction, are of one and the same piece with the station or of its platform respectively.

* * * * *